US005676795A

United States Patent [19]

Wizani et al.

[11] Patent Number: 5,676,795

[45] Date of Patent: Oct. 14, 1997

[54] PROCESS FOR THE PRODUCTION OF VISCOSE PULP

[75] Inventors: Wolfgang Wizani, Steyr/Gleink; Andreas Krotscheck, Lenzing; Johann Schuster, Schoerfling; Karl Lackner, Linz, all of Austria

[73] Assignees: Voest-Alpine Industrieanlagenbau GmbH, Linz; Lenzing Aktiengesellschaft, Lenzing, both of Austria

[21] Appl. No.: 446,819

[22] PCT Filed: Dec. 2, 1993

[86] PCT No.: PCT/AT93/00183

§ 371 Date: Jul. 13, 1995

§ 102(e) Date: Jul. 13, 1995

[87] PCT Pub. No.: WO94/12719

PCT Pub. Date: Jun. 9, 1994

[30] Foreign Application Priority Data

Dec. 2, 1992 [AT] Austria ..... 2382/92

[51] Int. Cl.[6] ..... D21C 1/02; D21C 3/02

[52] U.S. Cl. ..... 162/30.11; 162/19; 162/37; 162/38; 162/41; 162/68; 162/84; 162/86; 536/57

[58] Field of Search ..... 162/30.11, 19, 162/37, 38, 39, 40, 41, 43, 46, 68, 72, 60, 82, 84, 86; 536/56, 57, 70, 124

[56] References Cited

U.S. PATENT DOCUMENTS

| | | | |
|---|---|---|---|
| 1,742,218 | 1/1930 | Richter | 162/39 X |
| 1,780,347 | 11/1930 | Durchman | 162/38 |
| 1,831,435 | 11/1931 | Blodgett et al. | 162/84 |
| 1,839,773 | 1/1932 | Richter | 536/57 |
| 1,851,008 | 3/1932 | Hanson et al. | 536/57 |
| 1,852,466 | 4/1932 | McConnell | 536/57 |
| 2,301,314 | 11/1942 | Montonna et al. | 162/68 |
| 2,592,300 | 4/1952 | Limerick | 162/19 |
| 2,694,631 | 11/1954 | Richter et al. | 162/38 |
| 3,413,189 | 11/1968 | Backlund | 162/19 X |
| 3,532,597 | 10/1970 | Ljungovist | 162/84 |
| 3,832,279 | 8/1974 | Hess et al. | 162/82 |
| 4,123,318 | 10/1978 | Sherman | 162/19 |
| 5,053,108 | 10/1991 | Richter | 162/237 |
| 5,183,535 | 2/1993 | Tikka | 162/19 |
| 5,213,662 | 5/1993 | Henricson | 162/19 |

FOREIGN PATENT DOCUMENTS

| | | | |
|---|---|---|---|
| 605742 | 9/1960 | Canada | 162/19 |
| 1331924 | 8/1987 | U.S.S.R. | |

OTHER PUBLICATIONS

Database WPI, Section Ch, Week 8814, Derwent Publications Ltd., London, GB; Class F09, AN 88–097086.

*Primary Examiner*—Donald E. Czaja
*Assistant Examiner*—Jose Fortuna
*Attorney, Agent, or Firm*—Oblon, Spivak, McClelland, Maier & Neustadt, P.C.

[57] ABSTRACT

The present invention relates to a process for producing viscose pulp from lignocelluloses, such as hardwood, softwood or annual plants, in which process the lignocellulose is treated in a digester at first with saturated steam to prehydrolyze hemicelluloses and subsequently, without flashing, with hot black liquor (HSL) of a preceding sulfate pulp digestion as well as, if desired, under addition of fresh white liquor (WL) to neutralize the acidic reaction products formed, neutralization liquor (NL) thus being formed in the digester. Upon addition of the amount of alkali required for delignification in the form of fresh white liquor (WL), if desired, in combination with a displacement of neutralization liquor (NL) and temperature adjustment, digestion then will take place with or without temperature gradient. When reaching the desired degree of digestion, digestion is terminated by displacement of the hot black liquor (HSL) with cold alkaline washing filtrate (WF), at the same time the pulp is freed from still adhering lignin degradation products, and the thus obtained pulp is discharged from the digester at a temperature of below 100° C.

17 Claims, 12 Drawing Sheets

*EXAMPLE 1*

*1. CHIP FILLING*

TIME: 30 MIN.

555kg ATRO

CHIP

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 91 | 151 | 155 | 125 | 15 45 |
| EFFECTIVE ALKALI AS NaOH (EA g/l) | 9.81 | 3.1 | 15.95 | 101.6 | |
| SULFIDITY (SUL %) | | | 61.78 | 29.47 | |
| DRY SUBSTANCE (TS %) | | 20.35 | | | |

*2. PREHYDROLYSIS*

TIME: 60+45 MIN.

STEAM

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 91 | 133 | 155 | 125 | 107 165 |
| EFFECTIVE ALKALI AS NaOH (EA g/l) | 9.81 | - | 15.95 | 101.6 | |
| SULFIDITY (SUL %) | | | 61.78 | 29.47 | |
| DRY SUBSTANCE (TS %) | | - | | | |

*FIG. 2A*

*5. DISPLACEMENT NL BY HWL (+HSL)*

*6. HEATING*

*9. DISPLACEMENT WSL BY WASHING FILTRATE*

TIME: 16 MIN.

*10. DIGESTER EMPTYING*

TIME: 3 MIN.

*EXAMPLE 2*

*1. CHIP FILLING*

TIME: 30 MIN.

566kg ATRO

CHIP

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 90 | – | 155 | 125 | 15 40 |
| EFFECTIVE ALKALI AS NaOH (EA g/l) | 10.68 | 0 | 15.95 | 102.7 | |
| SULFIDITY (SUL %) | | | 46 | 30.8 | |
| DRY SUBSTANCE (TS %) | | 0 | | | |

*2. PREHYDROLYSIS*

TIME: 60+30 MIN.

STEAM

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 90 | – | 155 | 125 | 107 165 |
| EFFECTIVE ALKALI AS NaOH (EA g/l) | 10.68 | – | 15.95 | 102.7 | |
| SULFIDITY (SUL %) | | | 46 | 30.8 | |
| DRY SUBSTANCE (TS %) | | – | | | |

*FIG. 3A*

*7. DIGESTION*

TIME: 10 MIN.

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 90 | 152 | 155 | 125 | 156 156 |
| EFFECTIVE ALKALI AS NaOH (EA g/l) | 10.68 | - | 15.95 | 102.7 | |
| SULFIDITY (SUL %) | | | 46 | 30.8 | |
| DRY SUBSTANCE (TS %) | | - | | | |

*8. DISPLACEMENT HSL BY WASHING FILTRATE*

TIME: 19 MIN.

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 90 | 152 | 155 | 125 | 156 135 |
| EFFECTIVE ALKALI AS NaOH (EA g/l) | 10.68 | - | 14.69 | 102.7 | |
| SULFIDITY (SUL %) | | | 46.33 | 30.8 | |
| DRY SUBSTANCE (TS %) | | - | | | |

18731

*FIG. 3D*

*9. DISPLACEMENT WSL BY WASHING FILTRATE*

TIME: 16 MIN.

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 90 | 152 | 155 | 125 | 135 100 |
| EFFECTIVE ALKALI AS NaOH (EA g/l) | 10.68 | - | 14.69 | 102.7 | |
| SULFIDITY (SUL %) | | | 46.33 | 30.8 | |
| DRY SUBSTANCE (TS %) | | - | | | |

WARM BLACK LIQUOR (WSL)

*10. DIGESTER EMPTYING*

TIME: 3 MIN.

| | WASHING FILTRATE (WF) | NEUTRALIZATION LIQUOR (NL) | HOT BLACK LIQUOR (HSL) | HOT WHITE LIQUOR (HWL) | DIGESTER (KO) |
|---|---|---|---|---|---|
| TEMPERATURE (T°C) | 90 | 152 | 155 | 125 | 100 100 |
| EFFECTIVE ALKALI AS NaOH (EA g/l) | 10.68 | - | 14.69 | 102.7 | |
| SULFIDITY (SUL %) | | | 46.33 | 30.8 | |
| DRY SUBSTANCE (TS %) | | - | | | |

EVAPORATION LIQUOR (EDA)

BLOWING TANK (BLT)

*FIG. 3E*

PROCESS FOR THE PRODUCTION OF VISCOSE PULP

BACKGROUND OF THE INVENTION

Field of the Invention

The present invention relates to a process for producing viscose pulp according to a steam prehydrolysis sulfate (Kraft) displacement digestion process.

SUMMARY OF THE INVENTION

Viscose pulps are pulps that are used for the production of rayon, cellophane, carboxymethylcellulose, nitrocellulose, cellulose acetate, textile fibers and special papers. The specific characteristics of viscose pulps are a high purity and a high content of alpha cellulose.

Viscose pulps have a high content of alpha cellulose, a low content of hemicellulose, lignin, ashes and extraction substances. The elimination of hemicellulose in the digestion process is particularly difficult because pentosans are almost as resistant to alkalis and acids as the cellulose itself. The content of alpha cellulose is determined by dissolving pulp in 18% NaOH. Alpha cellulose is that part of cellulose which is not soluble in 18% NaOH. Beta cellulose is denoted that part of cellulose which precipitates at the subsequent dilution of the 18% solution and acidification. Gamma cellulose is denoted that part of the substances dissolved in 18% NaOH which does not precipitate when neutralizing of the solution. Roughly, one may say that alpha cellulose constitutes the cellulose normally present in plants, while beta cellulose is a measure for the cellulose degraded during chemical digestion and gamma cellulose constitutes a measure for the remaining hemicellulose content.

Depending on the end product, the demands as to the alpha cellulose content vary. For rayon, for instance, an alpha cellulose content of 88 to 91 will do. However, viscose pulps that are to be used for cellulose acetate, nitrocellulose or other derivatives must have a substantially higher alpha content, i.e., an alpha content of at least 94 to 98 and less than 1.5% of hemicellulose. Nitrocellulose for explosives usually are produced of linters, since for this purpose an alpha content of above 98% and a hemicellulose content of nearly 0% are required.

In contrast to paper pulp, wherefor a high content of hemicellulose is sought for reasons of tenacity, the hemicelluloses must be removed from viscose pulps. During the production of rayon, for instance, the xylanes react with $CS_2$ in the xanthonation reaction as rapidly as the cellulose itself, which leads to an elevated consumption of $CS_2$. Other hemicelluloses react more slowly than cellulose, thus involving difficulties in filtration.

All over the world, viscose pulp is produced primarily according to the sulfite process. With one-step processes, primarily the acidic sulfite process is employed because of its rapid hydrolysis of the hemicellulose as well as of the quite good delignification rate. Yet, bisulfite and neutral sulfite processes are also applied in two- and multi-step processes. In general, the following may be said in respect of sulfite digestion processes: Basically, they are carried out as batch cookings, i.e., discontinuously. The digestion temperature with sulfite processes is about 135° C., with bisulfite processes 160° C. With the heating of the digestion solution to the optimum digestion temperature, the pressure of the $SO_2$ gas in the digester will increase, excess $SO_2$ is blown off at an appropriate point of time. Digestion requires a total time of 6 to 8 hours.

Sulfidity, pH and temperature are the critical paremeters in determining the quality of the end product and its yield. Also, the type of base is of influence, in particular, on the rate of diffusion of the digestion chemicals into the chips. The degradation of hemicelluloses, in particular of xylanes and mannanes, primarily was effected by acidic hydrolyses of glucosidic bonds. The degraded hemicelluloses are removed from the pulp with the digestion solution. The degraded celluloses (beta celluloses) must be removed by subsequent alkaline treatment.

The cellulose in viscose pulps basically has a lower average degree of polymerization than in paper pulp. This is due to the acidity required for the removal of hemicelluloses, thus also partially degrading the cellulose hydrolytically. On account of this lower average degree of polymerization, sulfite viscose pulps cannot be employed for applications requiring high tenacities, such as, e.g., "high tenacity rayon cord".

One-step sulphite processes are not capable of digesting certain coniferous woods, such as, e.g., Douglas fir, larch and most of the pine types because of the high pitch content. The pitch content is particularly high in the heart wood region, therefore the digestion of saw timber waste by this process may be realized in some cases—since such timber mostly is sapwood. For this reason, two- or multi-step processes are applied in practice. The first step, as a rule, is less acidic than the second one. Thereby, the lignin is sulfonated in the first step, whereby recondensation of the lignin is prevented in the second step, which primarily serves to remove the hemicelluloses.

Sulfite digestion is effected with various bases, i.e., calcium, sodium, ammonium and magnesium.

The calcium sulfite process is dying out, since the recovery of the chemicals implies difficulties. Magnesium sulfite processes are widely used for the production of viscose pulp because of the simple recovery of the chemicals. In multi-step magnesium sulfite digestion processes, an acidic pH is applied in the first step. Otherwise, the digestion conditions in the magnesium sulfite process are largely identical with those of the known calcium sulfite digestion process.

By ammonium sulfite digestion, an even more rapid penetration of the chips by the digestion chemicals can be reached, thus shortening the heat-up time in some cases as compared to the calcium sulfite process, yet this process has a number of serious drawbacks, such as, e.g., elevated corrosion, intensified foaming problems in sorting because of the nitrogen forming, as well as a lower degree of whiteness of the pulp. The process that is most widely used in the industry is the sodium sulfite digestion process, which has been employed since the 50's. Among these, the Rauma-Repola process may, for instance, be mentioned, which has been in operation in Finland since 1962. It is a three-step process used for firwood and pinewood. The first step is a bisulfite step at pH 3–4 to impregnate the chips. The second step largely corresponds to conventional sulfite digestion, in which $SO_2$ is added and the viscosity of the pulp is determined. At the end of the second step, $SO_2$ is gassed off. In the third step, sodium carbonate is added to the digestion liquor for neutralization. Depending on the temperature and pH conditions, viscose pulps having alpha cellulose contents of from 89 to 95% are produced.

The Domsjo process, which has been in operation since 1960, is a two-step process by which high yields of viscose pulp are reached. In the first step, it is operated at a pH ranging from 4.5 to 6, the second step corresponds to normal acidic sulfite digestion. The pH of the second step is adjusted by the addition of $SO_2$-water. At a pH of 4.5 in the first step, yields are reached that are by 2% higher than those of a one-step process at accordingly low sorting losses. It is true that at a pH of 6 the yield may be increased by 4 to 5%, i.e., to 29 to 35%, yet to the expense of a higher glucomannane content. In accordance with the higher yield of this process, the content of alpha celluloses is below that of the afore-described process; with the one-step process it is 83 to 89% and with the two-step process it is 85 to 90%. Higher alpha cellulose contents at corresponding reductions in the yield may be achieved by a second treatment of the stock with diluted alkali at an elevated temperature, or with concentrated alkali at room temperature, and subsequent acidic treatment in order to eliminate the remaining inorganic substances.

The sulfate (Kraft) digestion process, in its common one-step realization, is not suitable for the production of viscose cellulose. Only 84 to 86% of alpha cellulose can be obtained by this embodiment. Extended cooking times or elevated cooking temperatures are not the right way, either. Rather, they cause a stronger degradation of the cellulose due to alkaline hydrolysis of the glucosidic bonds associated with a so called peeling-off reaction. In combination with an acidic pre-treatment—what is called pre-hydrolysis—high-quality viscose pulps can be produced from any raw materials common in pulp production by this alkaline digestion process. A number of viscose pulping plants are operated according to this process, water prehydrolysis with or without the addition of foreign acid exclusively being applied as a pretreatment.

Acidity in combination with reaction temperature are the decisive factors of this pretreatment. The addition of mineral acid reduces the time or the temperature required for hydrolysis. When treating lignocelluloses with aqueous media, organic acids are formed from the acetyl groups of the hemicelluloses, in particular, acetic acid, the pH thus being lowered to a value of 3–4 without the addition of acids. With lignocelluloses rich in xylane, such as, e.g., hardwood, the pH can further drop because of the high content of acetyl groups. The addition of mineral acids, in particular, of hydrochlorid acid, accelerates the hydrolysis reaction, yet has serious drawbacks, in particular, with regard to corrosion and process costs. The reaction conditions in prehydrolysis have an influence on the yield and quality of the viscose pulp, also influencing the delignification as well as the removal of further hemicelluloses in case of a recondensation of lignins as well as of condensable reaction products from hemicellulose hydrolysis. This will happen under particularly strong hydrolysis conditions in prehydrolysis and with raw materials having high lignin contents, such as, e.g., softwood.

Water prehydrolysis sulfate viscose pulps of softwood may reach alpha cellulose contents of 95–96% already before bleaching, yet about 3% lignin and 2–3% xylol still being contained. Hardwood, as a rule, contains more than 95% alpha cellulose, 1% lignin and 3–4% xylane. Xylanes usually are obtained by an after treatment with cold alkali during bleaching. This is, however, an expensive process step.

The prehydrolysis sulfate process is able to digest all of the raw materials common in pulp production, reaches substantially higher alpha cellulose contents, a substantially more uniform molecular weight distribution of such cellulose as well as higher average degrees of polymerization. As compared to the sulfite process, its lower yield is, however, disadvantageous, usually being only 28–30% prior to bleaching.

In the following, some processes are briefly mentioned, which are of no industrial relevance due to certain disadvantages:

The Sivola process substantially implies acidic sulfite digestions followed by after purification with hot sodium carbonate. For pulps having an alpha cellulose content and a purity comparable with those of prehydrolysis sulfate digestion, the following conditions are required: 170° C., 1–3 hours of digestion time, in the alkaline step with sodium carbonate at a chemical dosage of 150–200 kg/t in order to maintain a pH of 9–9.5, in addition 0.5–1% $SO_2$ must remain in the pulp during sodium carbonate cooking in order to reach a sufficient bleachability of the stock. The first step is carried out at 125°–135° C. for a period of treatment of 3 hours or more.

Prehydrolysis soda anthrachinone cooking has been known for a longer time than sulfate cooking, yet was not successful for various cost and quality reasons. The yield is low, the residual content of lignin is relatively high, the purity is poor and the average degree of polymerization of the alpha cellulose is low. In the consecutively arranged bleachery for the removal of residual amounts of lignin and hemicelluloses 1.7 times more bleaching chemicals, calculated as chlorine, are required than in the prehydrolysis sulfate process. A further economic disadvantage consists in the addition of 0.5% anthrachinone. This chemical involves considerable additional expenditures.

Organosolv processes for the production of viscose pulp are under development. With this process, which, so far, has been tested in the laboratory only, no substantial advantages in respect of alpha cellulose content and degree of delignification and, in particular, with regard to its economy that is decisively influenced by the necessity to recover the organic solvent, could be found as compared to the hitherto common sulfite and sulfate processed.

To sum up, it may be said that the known processes for the production of viscose pulp have different, yet serious drawbacks. Prehydrolysis sulfate processes are capable of digesting all of the common lignocelluloses, result in highly pure celluloses having high alpha cellulose contents with highly uniform molecular weights and high average degrees of polymerization, yet they have the disadvantage of a low yield as compared to sulfite processes (28–30% as compared to 30–35%). The production costs of viscose pulp substantially are determined by raw material costs and energy consumption. Another factor decisive for the future is environmental safety. In various regions, there have already been strict regulations as to waste water values, e.g., AOX, BOD, COD. While 6 kg AOX per ton of pulp were definitely acceptable some years ago, it must be departed from that these values will have to be about 0.5 kg or even zero in the near future. The same holds for the regulations governing pollution abatement. Any contaminating substance, i.e., substance other than alpha cellulose, in the starting material for the subsequent derivatization for the production of fibrous material has a substantial influence on the consumption of chemicals, on the waste water and on air pollution.

There have been a number of scientific investigations into the prehydrolysis with steam and subsequent digestion for the production of viscose pulp, thus, for instance, I. H. Parekh, S. K. Sodani and S. K. Roy Monlik "Dissolving Grade Pulps from Eucalyptus (Teretricornis) Hybride". There, the hydrolysis products forming are separated in various ways in order to supply the same to utilization and to reduce their established noxious influence on the quality of the pulp in subsequent cooking. On grounds of such difficulties, which are comprehensively summarized in the publication by H. Sixta, G. Schild and Th. Baldinger in "Das Papier", Pamphlet 9/92, p. 527–541, on "Die Wasservorhydrolyse yon Buchenholz", this possible process of prehydrolysis is not applied technically for the production of pulp.

Process improvements or new processes for the production of viscose pulp, therefore, must concentrate on quality standards, at least corresponding to water prehydrolysis Kraft pulp while increasing the yield and reducing the consumption of energy and chemicals associated with a relief of the environment in terms of waste water and waste gas.

The present invention is based on the objective of developing an energy-saving process for the production of viscose pulp from the lignocelluloses that are common in paper pulp production, which exhibits high alpha cellullose and low lignin contents associated with high viscosity and yield values already at the exit from the digester and whose subsequent further processing in washing, sorting and bleaching requires fewer technological expenditures and fewer bleaching chemicals, the process, thus, having substantial advantages in terms of product quality and costs as compared to conventional process for the production of viscose pulp.

In accordance with this objective, the application of a sulfite process is out of the question. As mentioned above, sulfite processes are able to digest only certain lignocelluloses, e.g., not common types of wood, such as pinewood, yield lower cellulose viscosities due to the elevated digestion temperature and acidity required, the alpha cellulose content after a two-step digestion reaches not more than 85–90% and after bleaching only 95–96%, the yield only amounts to 29–35%, and the end product is limited in its application, it is, for instance, not suitable for high tenacity rayon cord.

In addition to a still relatively low yield of 28–30%, a high energy demand in prehydrolysis and digestion, and a high consumption of chemicals in bleaching due to a low degree of delignification, the known water prehydrolysis sulfate processes have serious drawbacks caused by water prehydrolysis. In the work by H. Sixta et al. published in September 1992, from LENZING AG, a viscose pulp producer, it is noted in connection with this problem:

"Prehydrolysis is limited by the occurrence of side reactions that are difficult to control. In addition to the desired hydrolyric fragmentation reactions, subsequent reactions occur which, depending on the temperature and time, may adversely affect the process behavior in prehydrolysis and the subsequent delignification reactions in digesting and bleaching. The most important side reaction, the dehydration of pentoses to furfural, triggers undesired inter- and intramolecular condensation reactions. Pitch-like compounds are formed, which separate from the aqueous phase with the reaction continuing, depositing on any surfaces available. The deposition of these substances on the chips affects the diffusion-controlled mass transfer. This leads to increased pitch deposits on the phase interface and consequently to difficulties in the delignification reactions in digesting and bleaching and to a possible reduction of the yield, upgrading and purity of the pulp produced. Great problems are brought about in current operation by such pitch deposits due to gluing and obstruction."

Steam hydrolysis has not been used for large-scale pulp production because, in addition to similar problems of incrustation and obstruction, it leads to a poor product quality. In the above-cited publication, Sixta et al. comment on this as follows:

"In order to reduce the high energy costs incurred at the evaporation of the prehydrolysates, attempts have been made to reduce the bath ratio until pure steam prehydrolysis (bath ratio 1:1 to 1.5:1). However, this technologically very simple and elegant process has very negative effects on the pulp grade. Assays carried out by Havranek and Gajdos (especially with beech and fir) revealed that steam prehydrolysis is clearly held to be the reasons for the higher Kappa numbers, poorer bleachability, lower alkali resistance and reactivity of pulps. Our own investigations have confirmed the negative influence of steam prehydrolysis on pulp production".

The deposition of pitch-like substances on all surfaces available, which involve great problems by gluing and obstruction in the current operation and call for cleansing operations with production breaks, also have been known from furfural production by treatment of lignocellulose with steam. Also there, the poor quality of the celluose after steam treatment in acidic medium is confirmed. The residue from furfural production (60–70% of the raw materials used, essentially consisting of cellulose and lignin) is burnt or dumped.

Therefore, it is also an object of the invention to overcome the problems also associated with undesired byproducts as well as the serious negative effects of steam prehydrolysis on the quality of the end products and to combine the energetic and process-technological advantages of this process step with an energy and bleaching-chemical saving, extended displacement digestion.

The obvious removal of disturbing reaction products, e.g., by washing with steam or water was not successful. For instance, recondensation and deposits could not be avoided thereby; moreover, this intermediate step involves high energy losses.

Surprisingly, it was found—what could not be expected by one skilled in the art because of the comprehensive research and operational results—that the above-described complex problems could be solved and combined with the advantages of extended displacement digestion in that the reaction products from prehydrolysis are not separated, but prehydrolysis is completed by pump-filling the digester with HSL (hot black liquor) of a preceding digestion and with WL (white liquor) and subsequently a sulfate displacement technology associated with extended digestion ("extended delignification") under specific conditions is carried out.

Accordingly, the present invention has as its object a process for the production of viscose pulp from lignocelluloses according to a steam prehydrolysis sulfate (Kraft) displacement digestion process, which is characterized in that, after prehydrolysis with saturated steam, the digester is filled with hot black liquor (HSL) of a preceding digestion as well as, if desired, with fresh white liquor (WL) and the hydrolysis products are neutralized thereby, neutralization liquor (NL) thus being formed in the digester, that the amount of alkali required in digestion for delignification is supplied in the form of fresh white liquor (WL), thus, if desired, displacing a partial amount of NL, that the digestion takes place with or without temperature gradient, and that the digestion is completed by displacement of the digestion liquor (HSL) with alkaline washing filtrate (WF), thus washing the alkali-soluble lignin out of the digested fiber material and cooling the pulp for being discharged from the digester.

prehydrolysis; (3) digester filling; (4) neutralization; (5) displacment of NL; (6) heating; (7) digestion; (8) displacement of HSL; (9) displacement of WSL; and (10) digester emptying.

Figure 3B:
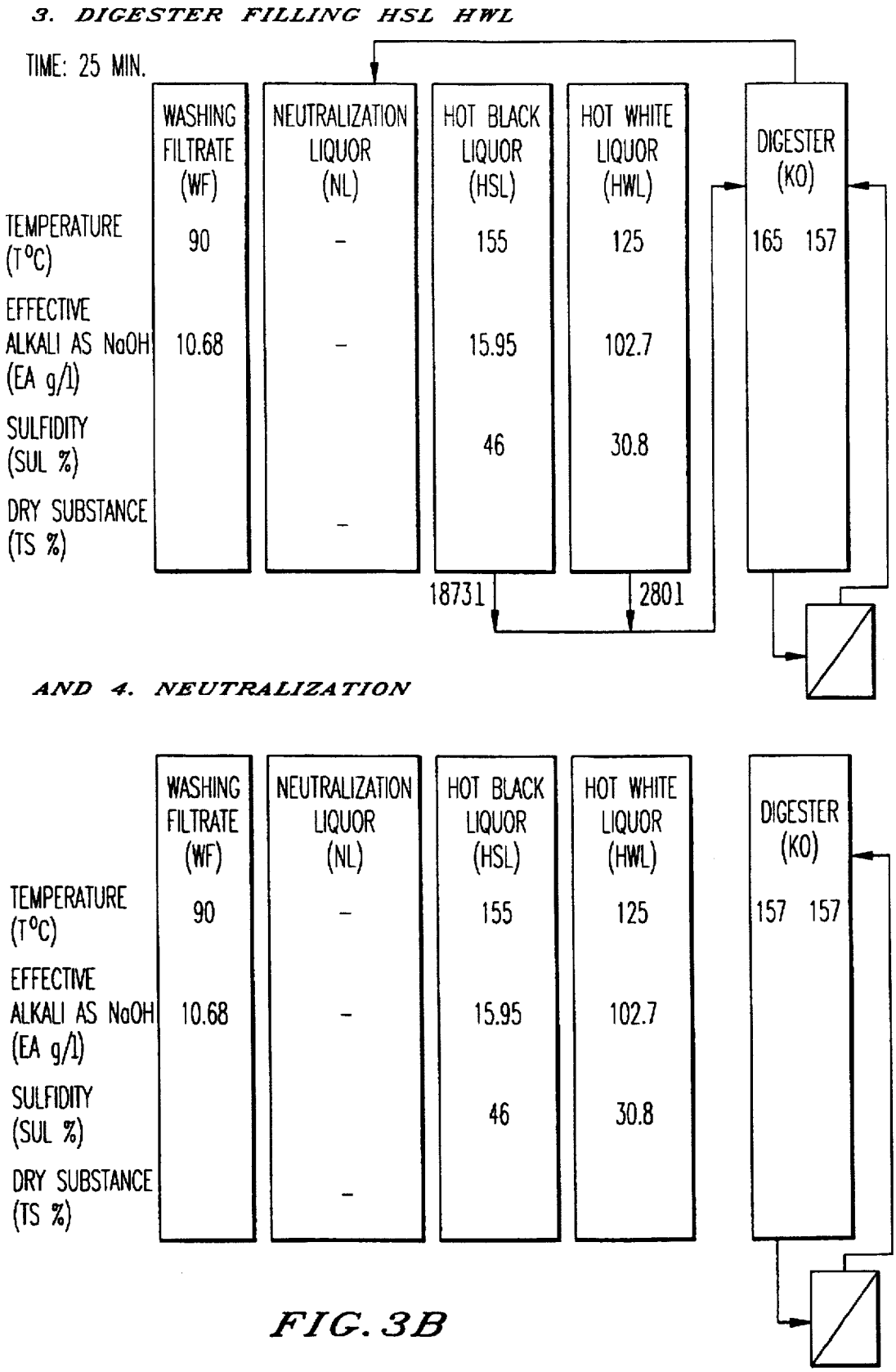
Figure 3C:
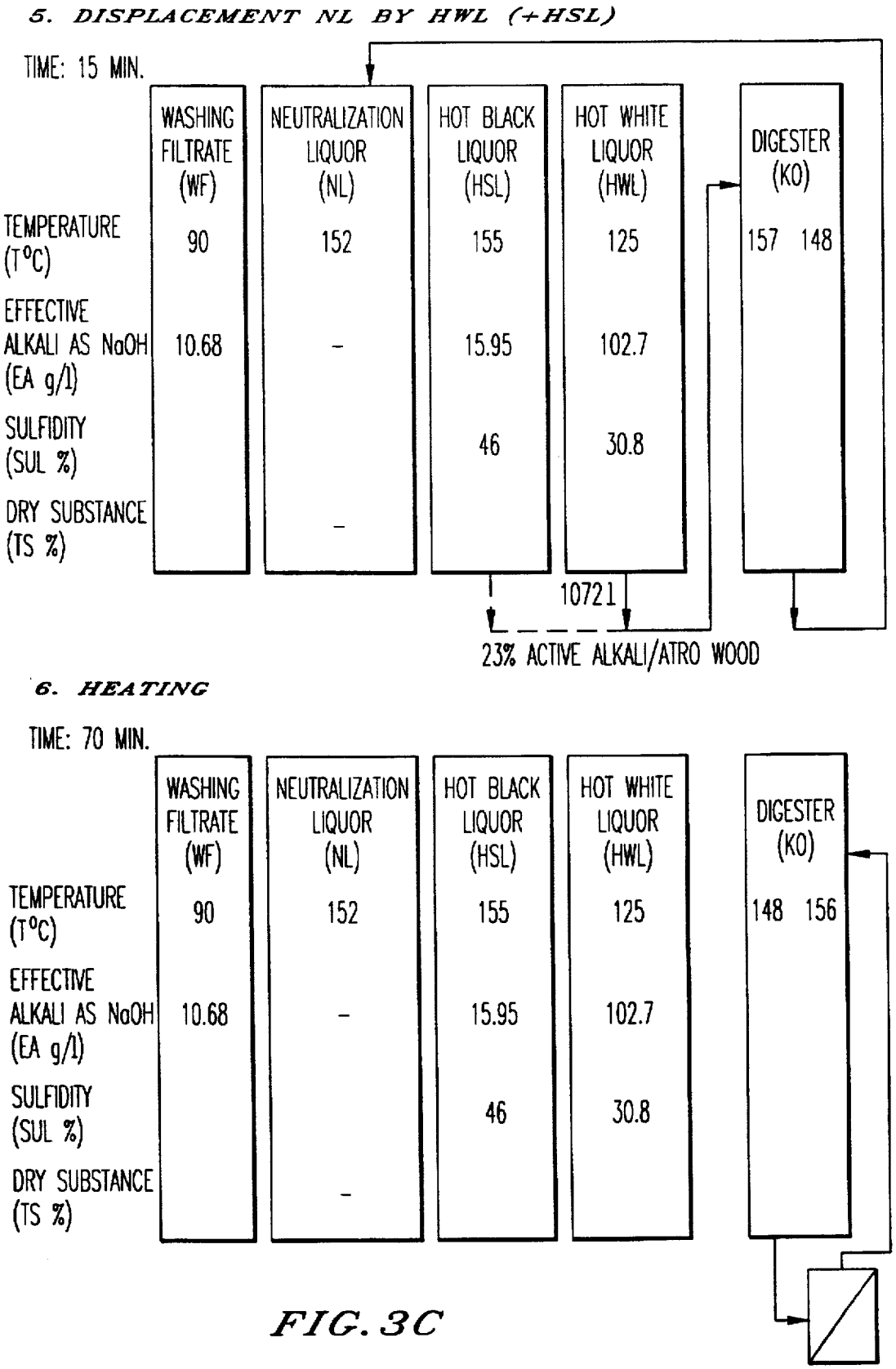

FIGS. 2 and 3 give the specific process parameters of Examples 1 and 2, respectively.

DESCRIPTION OF THE PREFERRED EMBODIMENTS

Figure 1A:
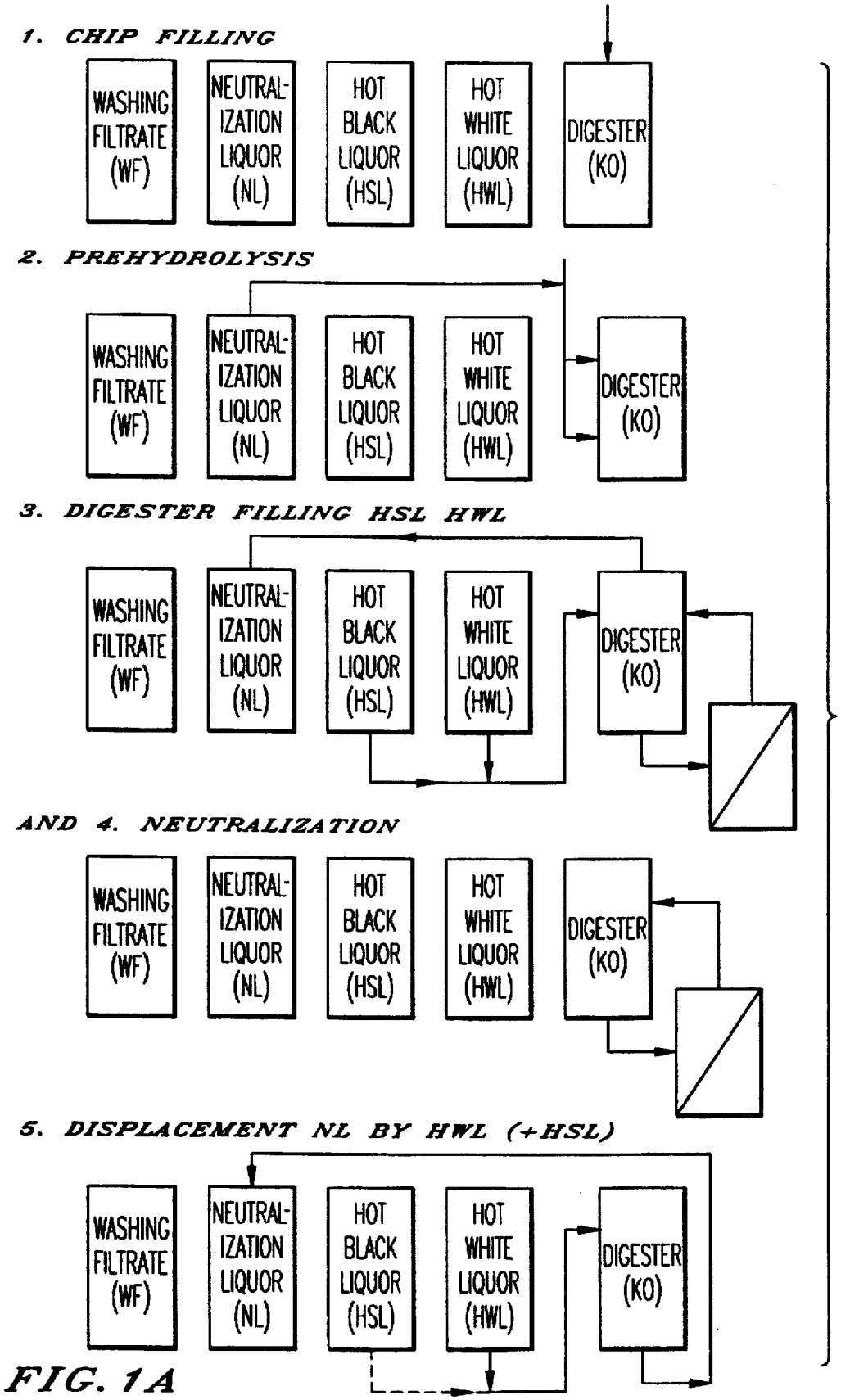
FIG. 1 shows the process scheme of a preferred embodiment. The figure shows the steps of: (1) chip filling; (2)
Figure 1B:
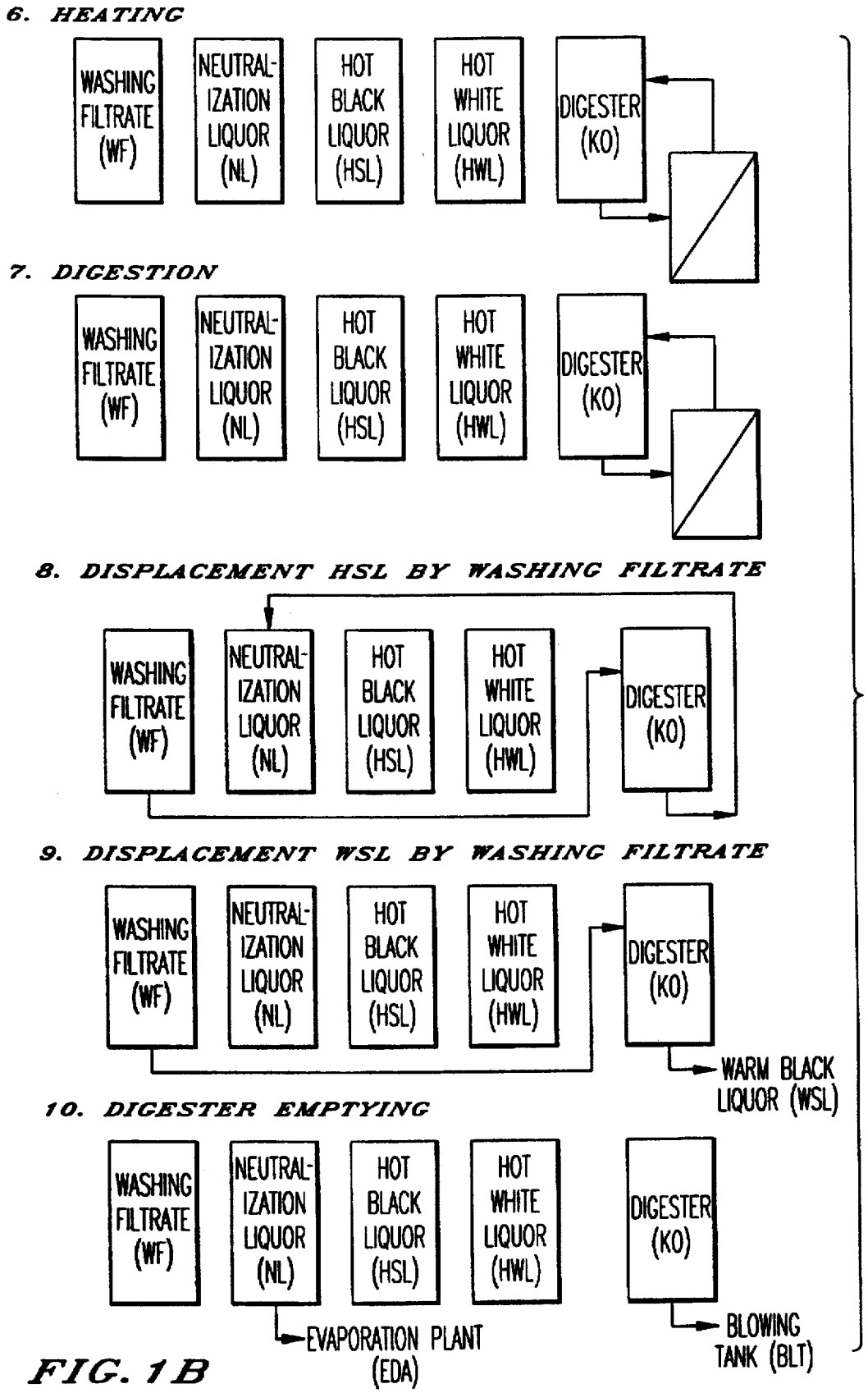
Figure 2B:
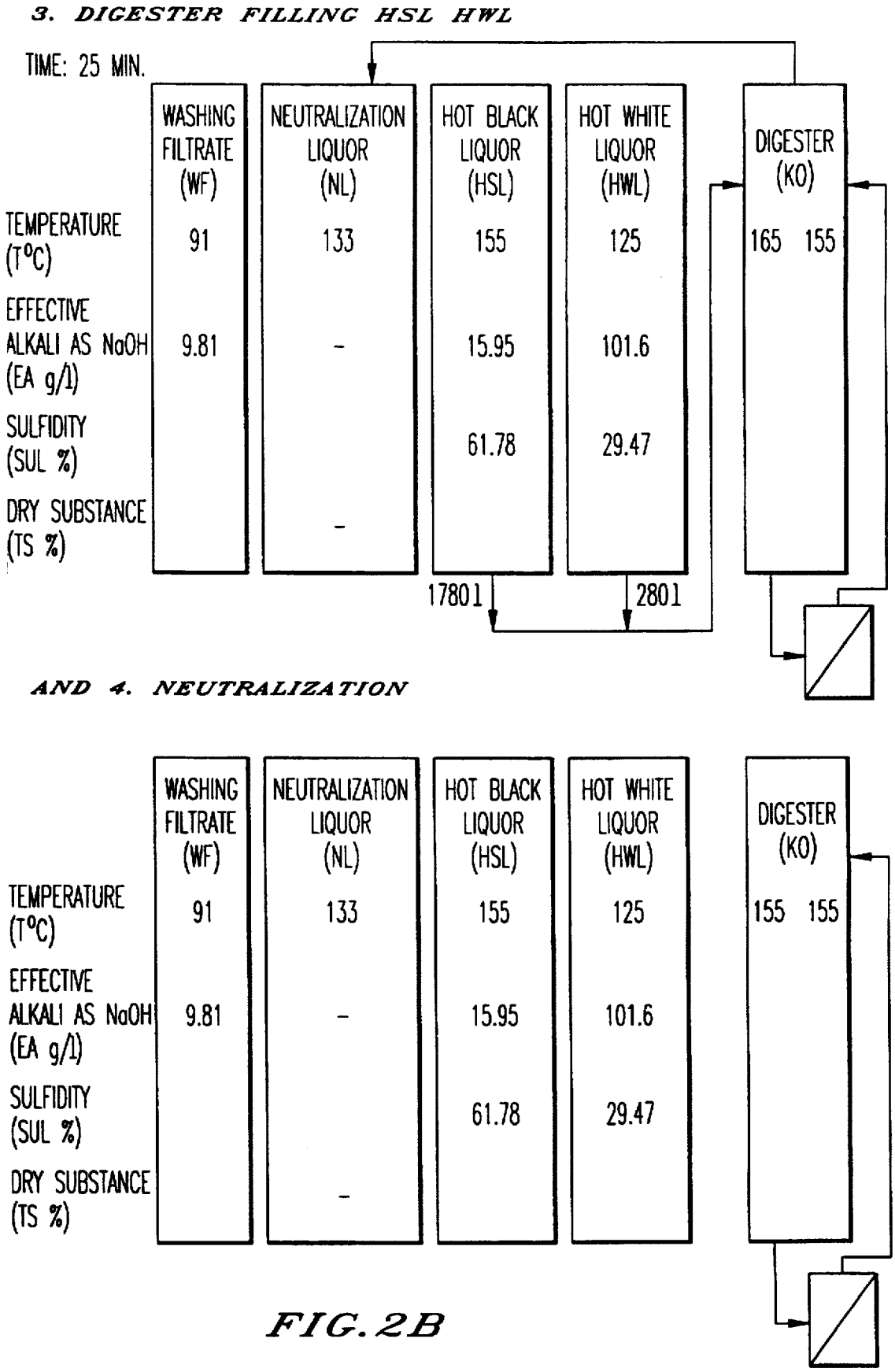
Figure 2C:
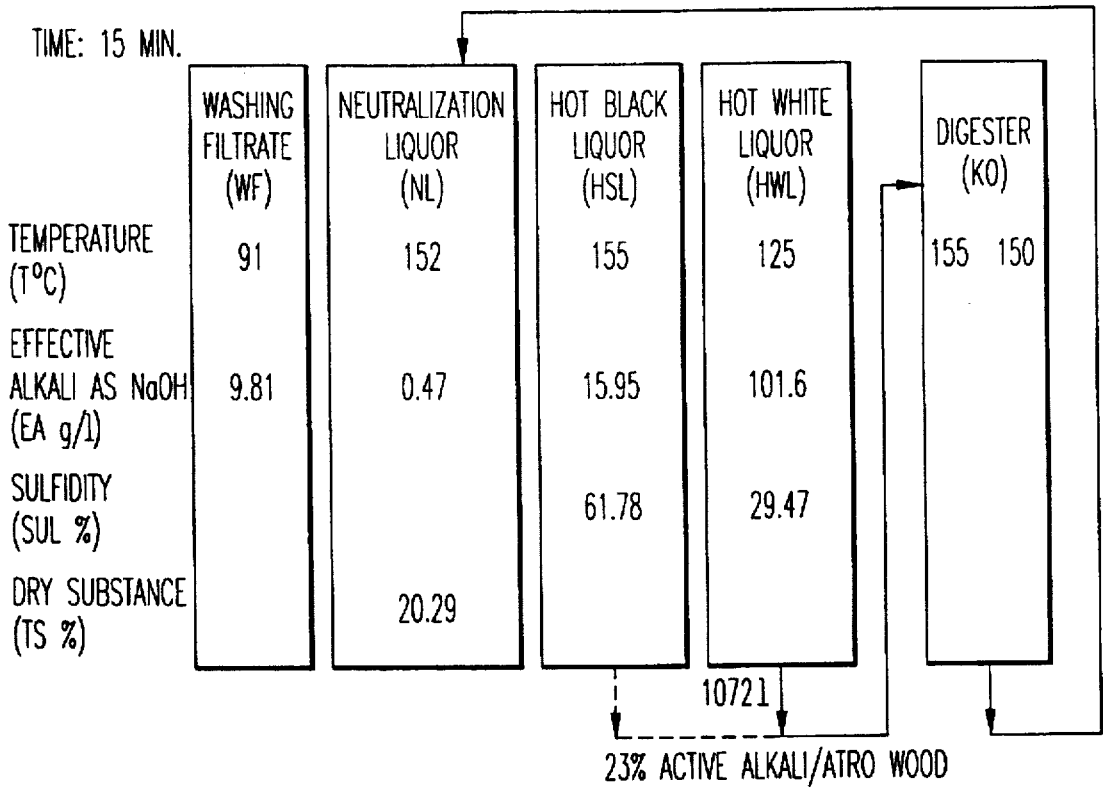
Figure 2C:
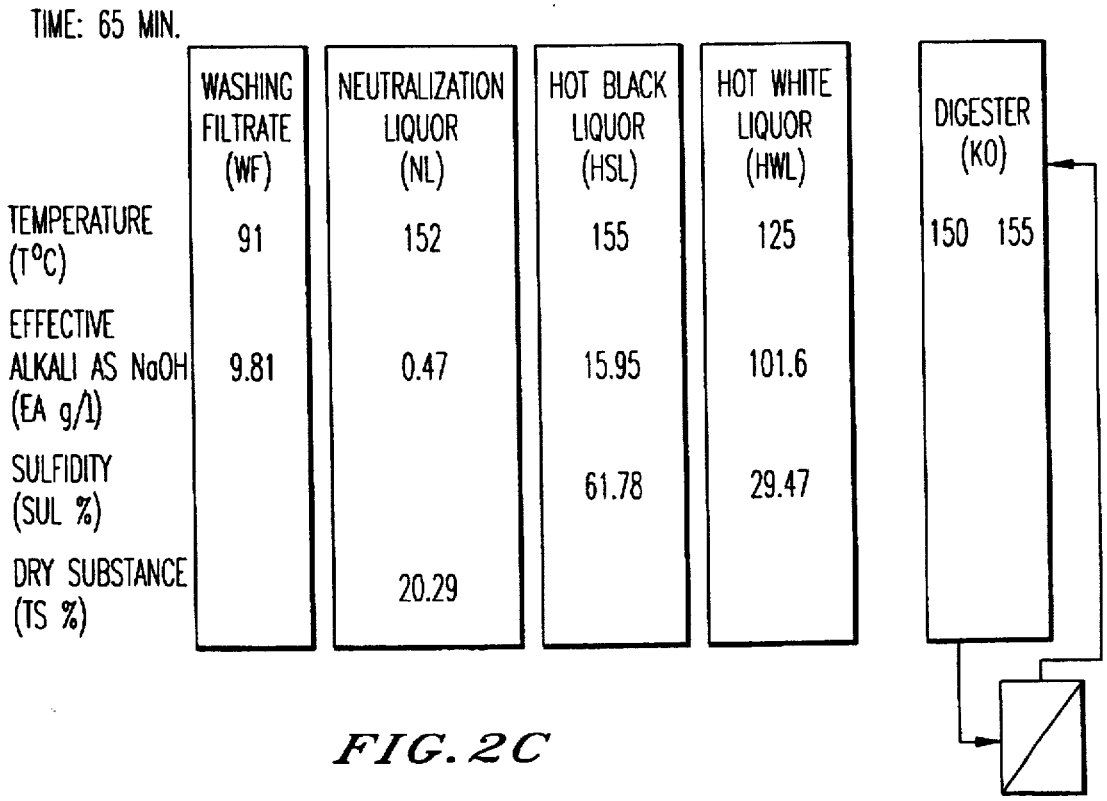
Figure 2D:
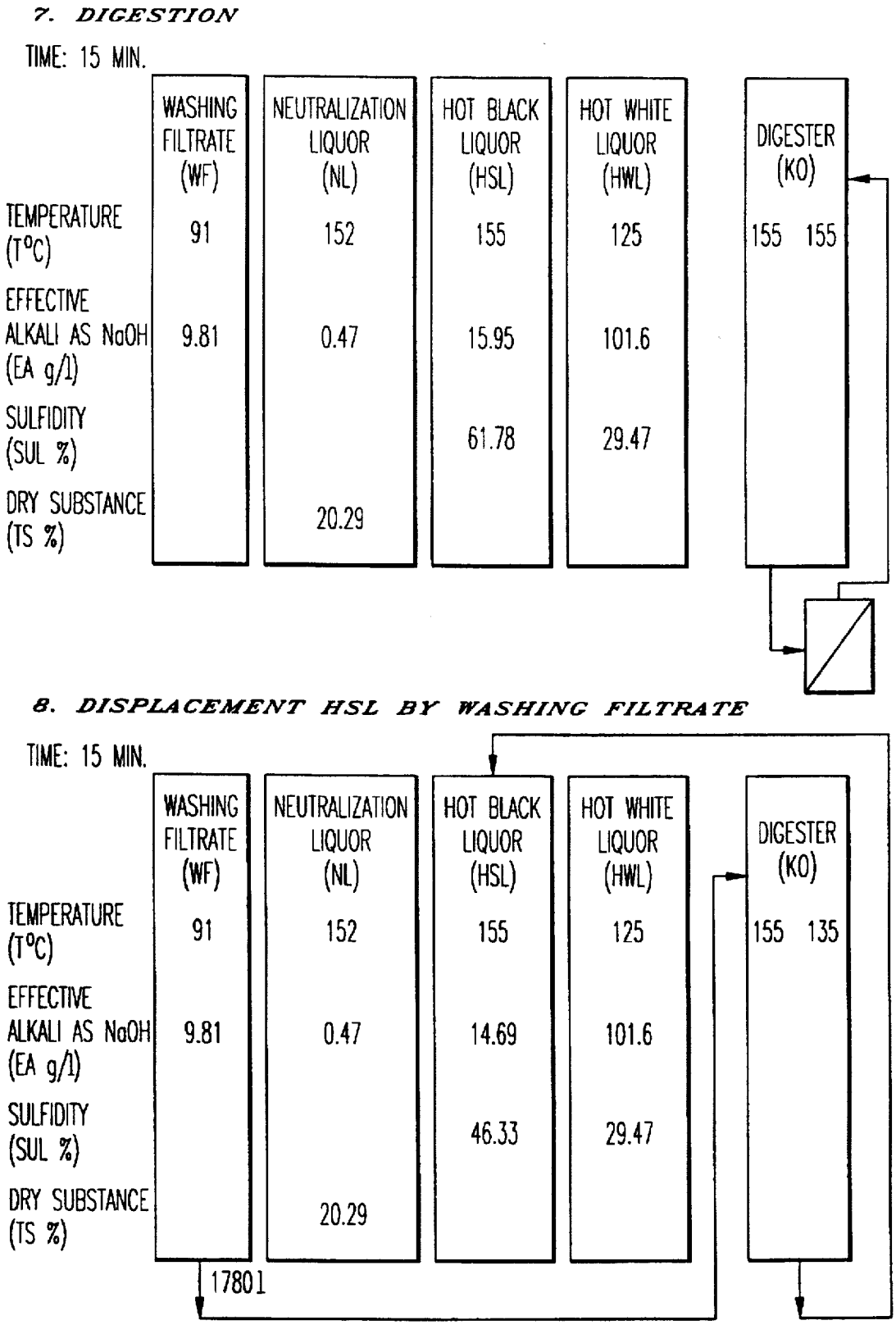
Figure 2E:
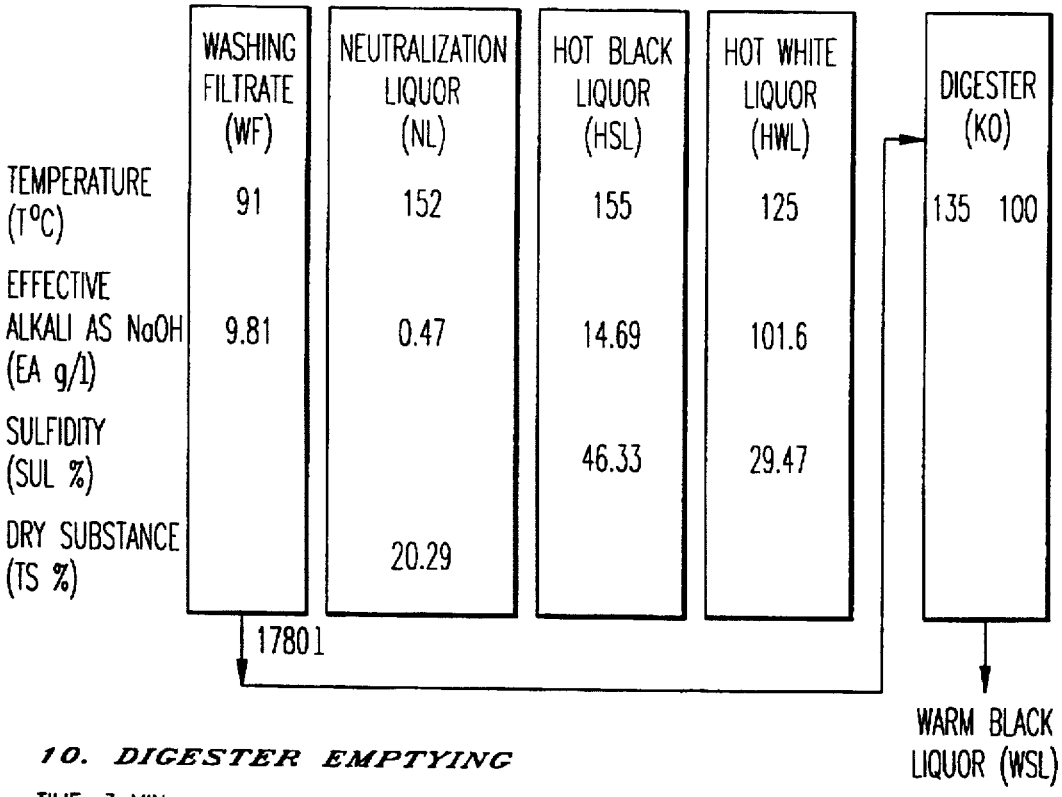
Figure 2E:
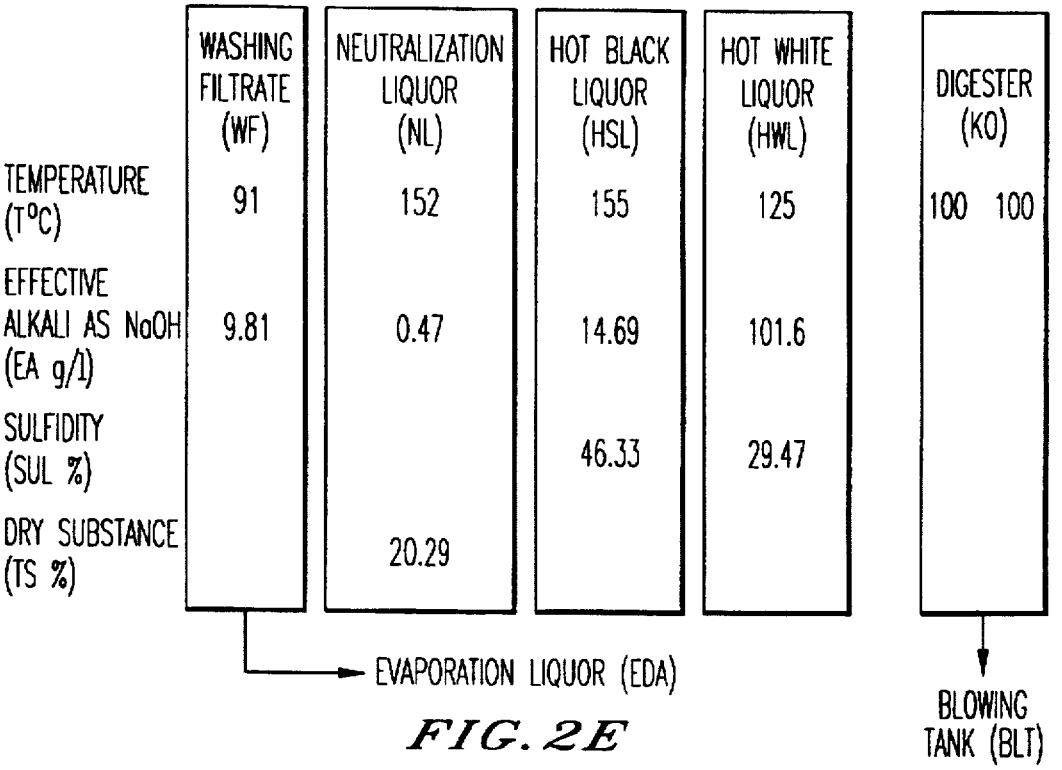

A preferred embodiment of the process in the form of a discontinuous course of process is represented in FIG. 1. A continuous course of process is,. however, likewisely feasible or conceivable—with the exception of prehydrolysis. In case of a discontinuous course of process, the process is divided into nine steps. Steam prehydrolysis and digestion of the chips take place in one and the same digester (KO). At least four vessels are required for the liquors for neutralizing the hydrolysis products from steam prehydrolysis and for the subsequent digestion, i.e., for the hot white liquor (HWL) for adjusting the necessary alkalinity of the liquors for neutralization and digestion; for the hot black liquor (HSL) from completed digestions; for the neutralization liquor (NL) forming of HSL by absorption of the hydrolysis products from steam prehydrolysis and directly conducted, after heat recovery, from the NL vessel to the evaporation plant (EDA) and subsequently to the liquor pan for chemical recovery and energy production; and for the alkaline washing filtrate (WF) from brown stock washing, by which HSL is displaced out of the digester and the digestion stock temperature is cooled to below 100° C. to terminate digestion. The warm black liquor (WSL) incurred at the end of the displacement of HSL by WF is conducted into a separate tank for heat recovery and subsequent further conduction to EDA.

In detail, the process steps of this preferred embodiment of the process according to the invention proceed as follows:

1. Chip filling:

Chips of usual size and quality are filled into a discontinuously operating digester (batch digester) of conventional design according to technologies common in pulp production, e.g., by means of a Svenson steam packer. To this end, steam is used which is produced from digestion liquor (HSL) in the course of energy recovery.

2. Prehydrolysis:

Chips and digester are heated to the desired prehydrolysis temperature ranging from 130° to 200° C., preferably from 130° to 190° C., most preferred from 155° to 175° C. To this end, fresh steam from energy recovery and flash steam from the pressure vessel of NL are used, whose temperatures are only slightly lower than that of prehydrolysis. The period of heating is 30 to 120 minutes, depending on the initial moisture of the raw materials, the initial temperature of the raw materials, the hydrolysis temperature and the steam used. Prehydrolysis itself is effected with saturated steam and lasts for 15 to 60 minutes, depending on the raw materials, the quality of the end product and on the temperature of prehydrolysis.

Preferably, the prehydrolysate is repumped from the bottom of the digester via an external duct during steam hydrolysis.

3. Filling of digester with HSL and HWL:

To complete prehydrolysis and to neutralize the hydrolysis products, HSL of a preceding digestion is pumped into the digester at the necessary overpressure, if desired, under admixture of hot white liquor (HWL). The digester is completely filled hydraulically with liquor. The conditions desired for neutralization, i.e., temperature and pH, may be adjusted by appropriate conditions of HSL and HWL prior to entering the digester. Filling of the digester takes 5 to 30 minutes, depending on the size of the digester and the pumping speed.

Filling of the digester, as a rule, is effected without separation of the gaseous and steam-volatile reaction products formed during prehydrolysis. Separation, e.g., for the recovery of products, such as furfural, acetic acid and methanol, according to processes of the prior art of industrial technology, is feasible without influencing the subsequent process steps for producing viscose pulp according to the present invention and without influencing the quality of the end product, yet it involves problems like, e.g., incrustations and obstructions, as is known from the literature in respect of steam prehydrolysis and from the industrial production of furfural with and without addition of mineral acid in the hydrolysis treatment of lignocelluloses with steam.

4. Neutralization:

For the uniform and complete neutralization of all acidic reaction products from prehydrolysis, the liquor in the digester is repumped via the upper and lower digester screens by an externally arranged pump - heat exchanger unit. In addition, temperature adjustment may be effected by means of the heat exchanger.

The pH of neutralization is to be higher than 9, preferably about 11. As soon as the desired neutralization conditions with regard to pH and temperature have been reached, the subsequent process step follows. Usually, the adjustment of the neutralization conditions takes 5 to 20 min. Displacement of NL by HWL:

5. To remove a partial amount of the neutralized hydrolysis products from prehydrolysis and to adjust the digestion conditions in respect of active alkali and, if desired, temperature, a partial amount of NL is displaced by HWL. HWL may be fed into the digester from top or bottom. With the preferred embodiment of the process of the present invention, displacement is effected from top to bottom. This direction of displacement gives rise to a more uniform process control and enhanced energy economy, since, because of the lower density of HWL as compared to NL, less mixing of HWL with NL occurs than with a displacement from bottom to top. This effect is even stronger in cases where HWL has a higher temperature than NL.

The extent of the NL partial amount that is displaced and conducted, via the NL vessel as an intermediate storage and via heat exchangers, to transferring heat to process liquors, in particular WL, and/or to producing hot water, to the evaporation plant (EDA), with subsequent burning in the liquor recovering vessel, depends on the raw material, on the end product and on the adjustment in neutralization. The amount displaced may range from zero to 100%. If no displacement takes place, neutralization is combined with the adjustment of the conditions for heating and digestion by appropriate adjustment of the amount and temperature of the supplied HSL and HWL in process step 3. The displacement of NL will be applied only with raw materials having low hemicellulose and extract contents, such as, e.g., linters or flax. As a rule, one to two thirds of NL are displaced. At high hemicellulose and extract contents as well as with extreme demands on the purity of the end product, it may be advantageous to replace the total amount of NL. When displacing large partial amounts of NL, it may be advantageous to apply a combined supply of HWL and HSL to adjusting the amount of active alkali necessary for digestion in the digester.

6. Heating:

Heating to the desired digestion temperature is effected by repumping the liquor through an externally installed pump heat exchanger unit, the heat from HSL or NL of a preceding digestion or from fresh steam being transferred. The time of heating may vary strongly. It may be zero if in neutralization (process step 4) or in the displacement of NL by HSL (+HWL) all of the parameters are adjusted for the beginning of digestion. In the other extreme, heating may coincide with the digestion time, if after neutralization and, if desired, displacement of partial amounts of NL the starting conditions of digestion have been adjusted and digestion is run with an increasing temperature gradient at which digestion is completed after having reached the maximum temperature.

7. Digestion:

During digestion, the digestion liquor is repumped through the externally installed pump—heat exchanger unit, the required heat being supplied to the heat exchanger via fresh steam. The digestion temperatures range between 140° and 185° C., with common kinds of wood and end products usually between 150° and 170° C. According to the type of heating and process control, the digestion time may last from some minutes to 3 hours.

8. Displacement of HSL with washing filtrate (WF):

Digestion is completed by displacing the digestion liquor (HSL) by means of cold alkaline washing filtrate from brown stock washing, the digested stock being cooled to below 100° C. and freed from still adhering lignin and other undesired soluble products by the alkaline washing procedure.

WF may be supplied from top or bottom. According to the process of the present invention, displacement from top is preferred. Because of the difference in the densities of the digestion liquor (HSL) and of WF, the advantages pointed out under process step 5 are particularly pronounced. The displacement of HSL is being effected into the HSL vessel until the temperature and hence also the content of dry substance of the displaced liquor has decreased by mixing thoroughly with WF. This liquor leaving the digester is called warm black liquor (WSL) because of its lower temperature.

9. Displacement of warm black liquor (WSL) by WF:

The displacement of the digestion liquor HSL by WF occurs without interruption. The displaced liquor is conducted into the HSL vessel as long as HSL volume is required for the subsequent digestion and the temperature of the displaced liquor corresponds to the temperature of the digestion liquor. After this, it is switched over to feeding into the NL and WSL vessels. WSL is supplied after heat exchange of EDA and liquor recovery.

Displacement is completed as soon as the stock within the digester has reached a temperature of closely below 100° C. As a rule, displacement in process steps 7 and 8 requires approximately 1.2 times the volume of the amount of liquid present in the digester.

10. Emptying of digester:

Emptying of the digester is effected according to the cold blowing process practiced in the production of pulp. Thereby, the stock is diluted to a consistency of about 5% with washing filtrate and either is blown out by applying pressure by means of steam or air or is discharged by pumping. In the process according to the invention, pumping out is preferred because it saves the fibers.

Examples 1 and 2 are described schematically in FIGS. 2 and 3, respectively.

As compared to the hitherto known prior art—multi-step sulfite processes and water prehydrolysis sulfate processes—the following essential advantages are achieved by the process according to the invention:

Alpha cellulose contents substantially higher than with sulfite processes and equal to or better than with sulfate processes.

Purity of the pulp substantially higher than with sulfite processes and equal to or better than with sulfate processes.

Tenacity and viscosity of the pulp substantially higher than with sulfite processes and, with equal alpha cellulose content and equal purity,. higher than with sulfate processes.

Yield of end product of digestion (before further processing, such as bleaching) and yield of alpha cellulose equal to or higher than with sulfate processes.

Yield and end product after further processing at equal alpha cellulose content substantially higher than with sulfite processes.

Portion of alpha cellulose in end product of digestion (before further treatment, such as bleaching) equal to or higher than with sulfate processes and substantially higher than with sulfite processses.

Steam prehydrolysis combined with displacement technology of sulfate digestion renders feasible the saving of steam over the entire digestion process including auxiliary means, such as chemical recovery, as compared to water prehydrolysis sulfate processes by about 50 to 60%, i.e., based on an equal amount of washed pulp, an equal alpha cellulose content (about 96%), only 40 to 50% of the energy used so far with conventional sulfate processes is required for the process according to the present invention.

What is claimed as new and is desired to be secured by letters patent of the U.S. is:

1. A process for producing viscose pulp from lignocelluloses according to a steam prehydrolysis sulfate (Kraft) displacement digestion process, comprising the steps of:

i) in a digester, prehydrolysing lignocellulose with saturated steam;

ii) neutralizing the prehydrolysed lignocellulose by adding a hot black liquor, and optionally fresh white liquor; thereby forming a neutralization liquor;

iii) digesting and delignifying the neutralized lignocellulose by adding a fresh white liquor and optionally heating, thereby displacing a partial amount of said neutralization liquor, forming a digestion liquor, and forming a digested fiber material and lignin;

iv) washing said lignin from said digested fiber material by adding an alkaline washing filtrate, thereby displacing said digestion liquor and forming a viscose pulp; and v) cooling and discharging said viscose pulp.

2. The process according to claim 1, wherein in said step i) a prehydrolysate is formed and said prehydrolysate is repumped from the bottom of said digester and returned to said digester through an external duct during steam prehydrolysis.

3. The process according to claim 1, wherein said hot black liquor in said step ii) is from a previous digestion and has a temperature ranging from 80° to 250° C.

4. The process according to claim 1, wherein in said step iii), an amount of said fresh white liquor is adjusted wherein after complete filling of said digester a pH of more than 9 is reached.

5. The process according to claim 4, wherein the adjustment of said pH and a temperature of said neutralization liquor is effected by admixing said fresh white liquor with said hot black liquor or by temperature adjustment of said hot black liquor prior to introduction into said digester.

6. The process according to claim 1, wherein said hot black liquor is supplied from the top of said digester.

7. The process according to claim 1, wherein said hot black liquor is supplied to the bottom of said digester.

8. The process according to claim 1, wherein said step iii) further comprises a temperature increase and an amount of active alkali, said temperature increase and said amount of active alkali both being effected by displacement of a portion or of a total amount of said neutralization liquor by said fresh white liquor and, optionally, with said hot black liquor.

9. The process according to claim 8, wherein said displacement is effected from the top of said digester to the bottom of said digester.

10. The process according to claim 8, wherein said displacement is effected from the bottom of said digester to the top of said digester.

11. The process according to claim 1, wherein said digesting in said step iii) is effected with an amount of active alkali of 18–28% as NaOH, based on absolutely dry lignocellulose, at a temperature of 140°–185° C. and digestion times of 40 to 180 minutes, said times including a time for said heating.

12. The process according to claim 1, wherein said step iii) further comprises a temperature and a digestion time, wherein an increase in said temperature is linear with said digestion time.

13. The process according to claim 1, wherein said digesting is completed by displacement of said hot black liquor by said fresh white liquor of an alkalinity and a temperature that said lignin in said step iii) is alkali soluble and does not recondense and wherein a temperature in said cooling is lowered to below 100° C. for said discharging.

14. The process according to claim 1, wherein said displacing of said digestion liquor by said washing filtrate is effected from the top of said digester to the bottom of said digester.

15. The process according to claim 1, wherein said displacing of said digestion liquor by said washing filtrate is effected from the bottom of said digester to the top of said digester.

16. The process according to claim 1, wherein said digesting in said step iii) further comprises a temperature and a digestion time, said temperature increasing with said digestion time, the rate of the temperature increase being lower at the beginning of said digestion time than the rate at the end of said digestion time.

17. The process according to claim 1, wherein said step iii) further comprises a temperature and a digestion time, said temperature increasing during an initial portion of said digestion time, then remaining constant to the end of said digestion time.

* * * * *